US007431266B1

(12) United States Patent
Evans

(10) Patent No.: US 7,431,266 B1
(45) Date of Patent: Oct. 7, 2008

(54) POST PULLER

(76) Inventor: Terry Evans, 294 Planters Grove, Ridgeland, MS (US) 39157

( * ) Notice: Subject to any disclaimer, the term of this patent is extended or adjusted under 35 U.S.C. 154(b) by 0 days.

(21) Appl. No.: 11/906,620

(22) Filed: Oct. 3, 2007

(51) Int. Cl.
*E21B 19/00* (2006.01)

(52) U.S. Cl. ..... 254/30

(58) Field of Classification Search ..... 254/30, 254/132, 18, 133 R, 31
See application file for complete search history.

(56) References Cited

U.S. PATENT DOCUMENTS

| | | | | |
|---|---|---|---|---|
| 1,153,024 | A * | 9/1915 | Brown | 294/104 |
| 3,734,463 | A | 5/1973 | Enright | |
| 4,804,165 | A * | 2/1989 | Pippin et al. | 254/30 |
| 5,161,781 | A | 11/1992 | Sohocki | |
| 6,302,377 | B1 * | 10/2001 | Pimentel | 254/30 |
| 6,527,250 | B1 * | 3/2003 | Tyson | 254/30 |
| 7,059,587 | B1 * | 6/2006 | Fimple | 254/30 |
| 7,125,000 | B1 * | 10/2006 | Saavedra et al. | 254/30 |
| 2007/0018144 | A1 * | 1/2007 | Saavedra et al. | 254/30 |

* cited by examiner

*Primary Examiner*—Lee D Wilson
(74) *Attorney, Agent, or Firm*—Stanford Patents LLC; George E. Stanford, Jr.

(57) ABSTRACT

The present invention concerns a post puller apparatus featuring a plurality of clutching fixtures for extracting posts embedded in the ground, particularly round metal posts that are often difficult to hold firmly. Each such clutching fixture is formed to have a rectangular horizontal plate and a rectangular vertical plate perpendicular to each other along an edge of each. The horizontal plate has a clutch jaw of a generally V shape for receiving a portion of the post to be removed from the ground; the vertical plate has a pair of slots flanking the clutch jaw. Two or more of these clutching fixtures are longitudinally attached to a longitudinal support member, which is normally operative in a vertical position and operatively conjoined with a device providing an upward post extracting force. The longitudinal support member has a maneuvering handle for positioning the post puller apparatus proximate to a post to be removed. Following this maneuver, loose chain for each clutching fixture is wrapped around a portion of the post to be removed, the encircling chain interposed between the clutch jaw and a portion of the post, each loose end of the chain secured in one of each of the slots flanking the clutching jaw. Upon application of an upward extracting force, the chain encircling the post tightens, securely and firmly holding the post in the post pulling apparatus during the extraction process.

16 Claims, 6 Drawing Sheets

POST PULLER

BACKGROUND

1. Field of the Invention

The present invention concerns generally a post puller. In particular, the present invention is directed to an apparatus for efficiently clutching and extracting posts embedded in the ground, especially round metal posts which are often difficult to hold firmly during extraction, the post pulling apparatus functioning without having to pass the clutching mechanism over the free end of the posts, such posts including T cross-section posts, rectangular posts and round posts of differing diameters.

2. Description of the Related Art

Whether of urban, suburban, or rural locale, there are numerous and continuing instances entailing the placement in the ground of fence posts, sign posts, and the like. Depending upon the situation and economics, the cross-section of such posts and poles can include T-section, rectangular, square, and round; the material can be, wood, metal, or plastic. A frequent corollary to this ageless process is the need for subsequent extraction of those embedded posts and poles. As a consequence of this continuing problem, many devices have been devised and invented to expedite the extraction process. Development of such devices has had to confront numerous problems, including; slippage of the clutching mechanism holding the post; clutching mechanisms that need to be placed over the free end of the post; excessive preparation or setup required prior to extracting the post; excessive damage to the post during removal.

Perusal of patents issued during the past 35 years reveal an interest focused on a carriage featuring both a means for transporting the extraction apparatus to the job site and also means for providing an upward force to extract the post. With certain exceptions, clutching, that is, gripping or a holding tightly or firmly, the object to be extracted was given lesser attention.

Generally loose chain was wrapped around the object to be extracted. An adequate clutching force was sought by multiple encirclement of the post by the chain. For larger diameter wooden poles, a chain snubbing and pole gripping device could be physically attached to the pole and used in conjunction with a loose chain wrapped around the pole. U.S. Pat. No. 3,734,463 "CHAIN SNUBBING AND POLE GRIPPING DEVICE FOR POLE RAISING APPARATUS" is incorporated herein by reference for purposes of indicating the background of the present invention or illustrating the mature state of the art for clutching and extracting large diameter wooden poles.

Loose chain wrapped around a post was also used for smaller diameter posts embedded in the ground. Some of these devices utilizing loose chain have been mounted on carriages for ease and convenience in moving the device on the ground, and additionally incorporating a mechanism for applying an upward force to the post extraction effort. U.S. Pat. No. 6,302,377 "POST PULLING APPARATUS" is incorporated herein by reference for purposes of indicating the background of the present invention or illustrating the mature state of the art for the use of loose chain to clutch a small diameter post to be removed.

Loose chain has been known to slip when utilized to clutch a metal pole. Various pole and post clutching mechanisms have been devised and invented in an attempt to overcome and solve this problem. In some instances, the gripping mechanism, such as a fixed metal collar, must be passed over the free end of the post. In other cases, two opposing rigid surfaces act together to grip or clamp the post to be removed. U.S. Pat. No. 5,161,781 "TOOL ASSEMBLY FOR USE IN PULLING FENCE POSTS" is incorporated herein by reference for purposes of indicating the background of the present invention or illustrating the mature state of the art for utilizing an unsymmetrical gripping mechanism that additionally does not need to be passed over the free and the post.

In like manner, a symmetrical gripping mechanism can be utilized to clutch the post. U.S. Pat. No. 7,059,587 "POST PULLER" is incorporated herein by reference for purposes of indicating the background of the present invention or illustrating the mature state of the art for utilizing a symmetrical clutching mechanism that does need to be passed over the free end of the post.

Since the gripping surfaces of such devices are rigid, the gripping surface is largely dependent upon the diameter of the post. Consequently, if the diameter of the post is not particularly favorable, the gripping surface area may be too small and there is apt to be slippage of the post. The present invention provides a simple, efficient solution to the preceding deficiencies.

SUMMARY

An objective of the present invention is to provide a post-puller that is particularly simple and efficient to adjust and use, utilizing only a single encirclement of the embedded post with a chain. Another objective of the present invention is to provide a post-puller that is particularly effective in the extraction and removal of tubular steel posts which, because of their smooth surface, tend to slip in conventional post-puller devices. Another objective of the present invention is to provide a post-puller that is readily usable with posts of differing diameter, material, and cross-section. Another objective of the present invention is to provide a post-puller whose clutching mechanism can be placed around the post and does not need to be placed over the free end of the embedded post. Yet another objective of the present invention is to provide simple alignment of the longitudinal axis of the pole to be extracted with the longitudinal axis of the clutching mechanism, thereby maximizing the vertical lifting force by eliminating any horizontal components of the extraction force. A further objective of the present invention is to provide a post remover that is simple to manufacture.

BRIEF DESCRIPTION OF THE DRAWINGS

1.

2.

3.

4.

Figure 1:
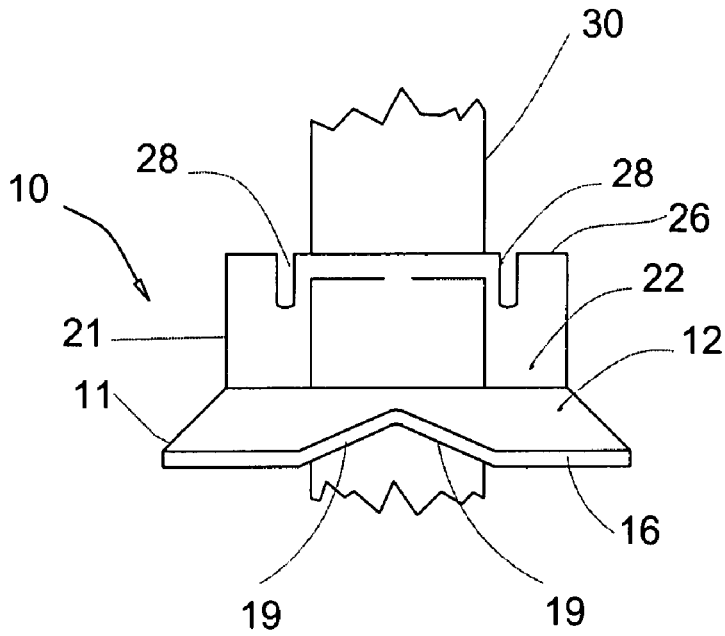
FIG. 1 is a frontal perspective view, illustrating an embodiment of the clutching fixture component of the present invention, without loose chain. As shown, clutching fixture 10 comprises a horizontal rectangular plate 11 perpendicularly conjoined to a vertical rectangular plate 21. The horizontal rectangular plate 11 features an anterior clutch surface 12, and a forward clutch surface 16 which opens to a pair of opposed clutch jaw edges 19. The vertical rectangular plate 21 is shown to possess an anterior slot surface 22, an upper slot edge 26, and a pair of slots 28. Behind the clutch fixture 10 is the longitudinal support member 30. Note that in this depiction, the pair of opposed clutch jaw edges 19 are linear.

Positioning handle 34 is attached upper longitudinal support pedestal 32 and also to handle pedestal 35, which, in turn, is attached to longitudinal support member 30. Also shown in this depiction is posterior clutch surface 14.

Figure 5:
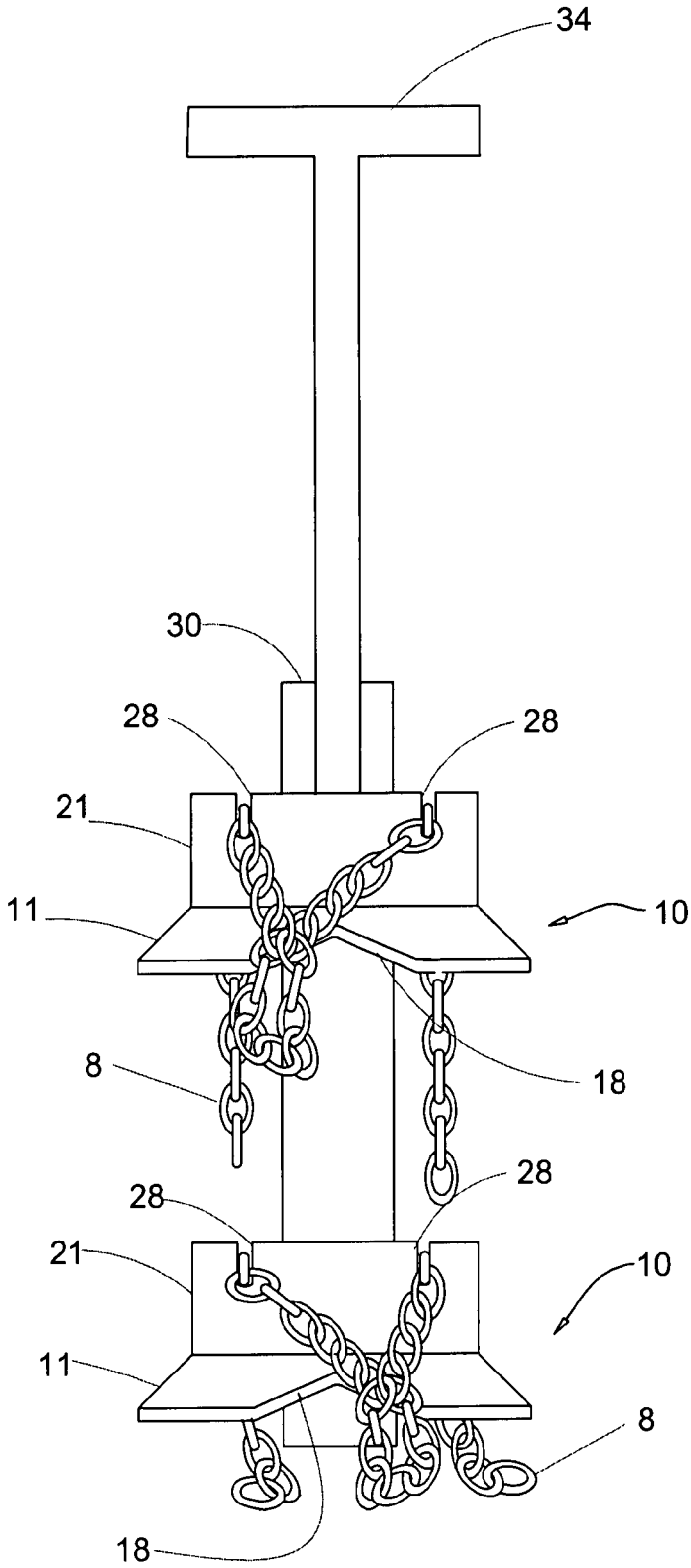

5. FIG. 5 is a frontal perspective view, illustrating a preferred embodiment of the present invention, with loose chain 8 engaged in the slots 28.

Figure 6:
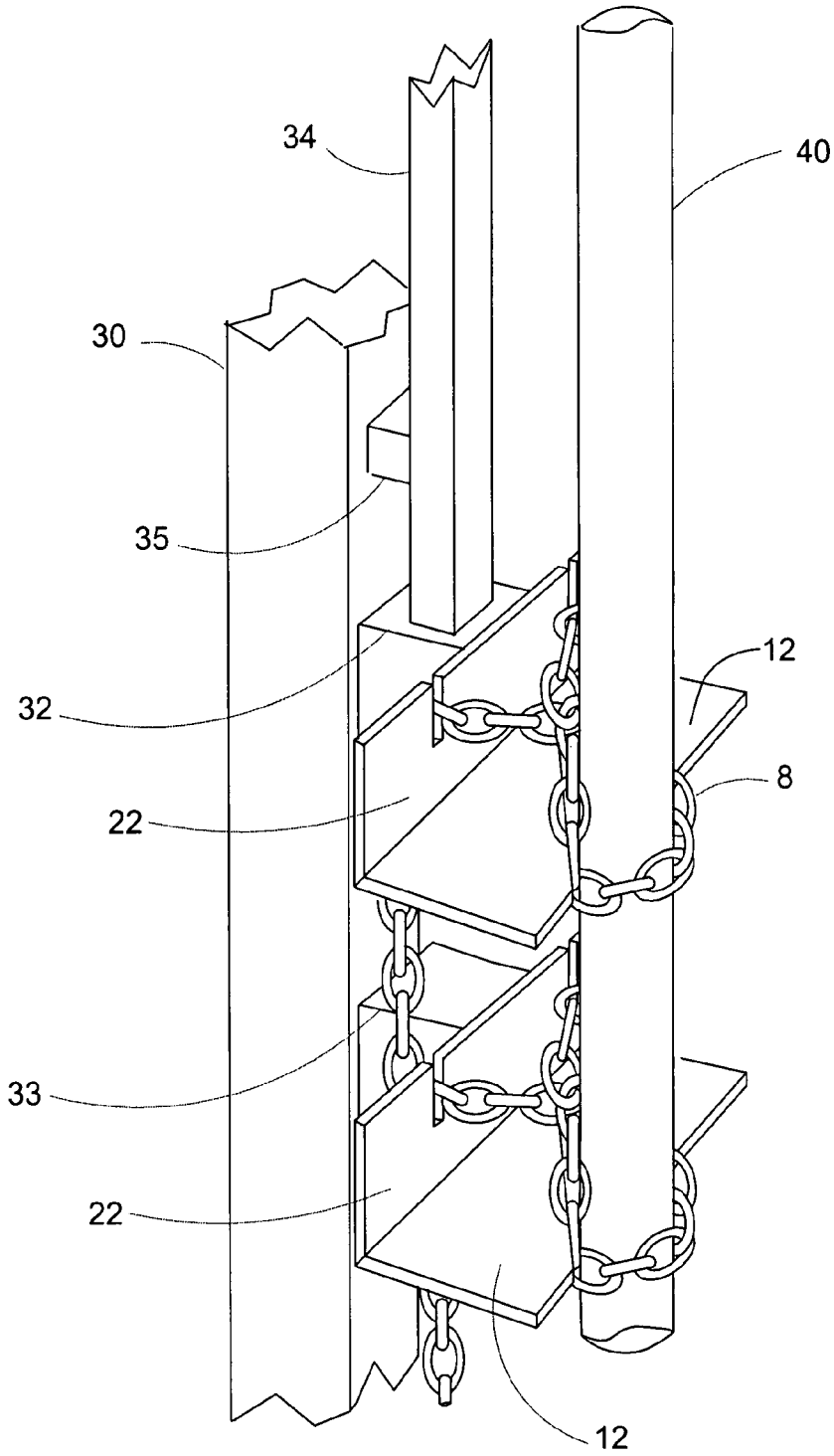

6. FIG. 6 is a perspective view, illustrating a preferred embodiment of the present invention, with loose chain encircling and engaging a post 40 to be extracted.

Figure 7:
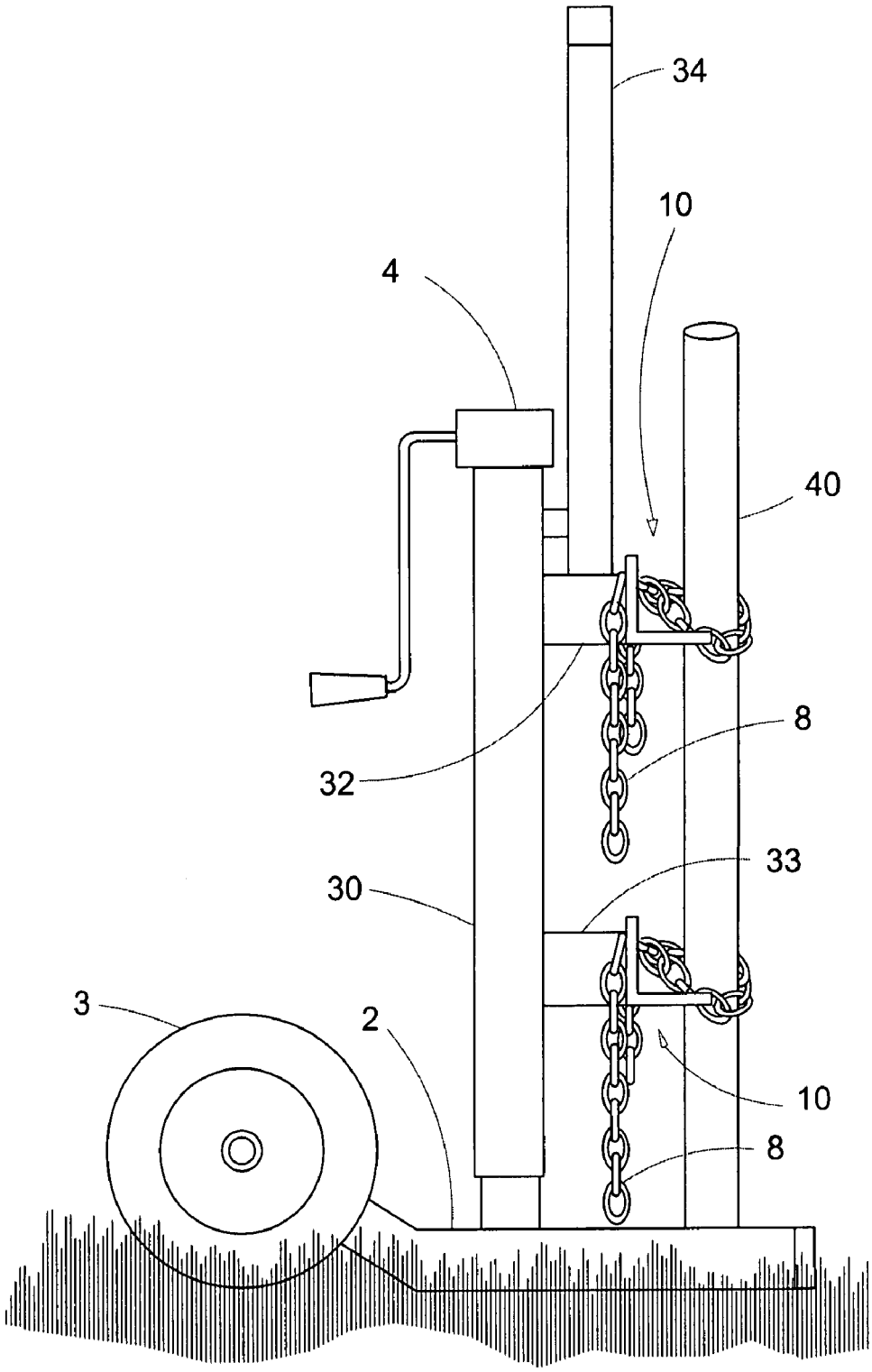

7. FIG. 7 is a side view, illustrating a preferred embodiment of the present invention, mounted on a portability carriage 2 (not claimed in the present invention), with loose chain 8 encircling and engaging a post 40 to be extracted. The portability carriage 2 features carriage wheels 3 (not claimed in the present invention) and a lifting force device 4 (not claimed in the present invention). This preferred embodiment comprises a pair of clutching fixtures 10, the upper fixture attached to longitudinal support member 30 by means of upper longitudinal support pedestal 32, the lower fixture attached to longitudinal support member 30 by means of lower longitudinal support pedestal 33. The positioning handle 34 expedites simple positioning of the present invention in close proximity to a post 40 for subsequent clutching and extraction of the embedded post.

DESCRIPTION OF THE PREFERRED EMBODIMENT

Figure 2:
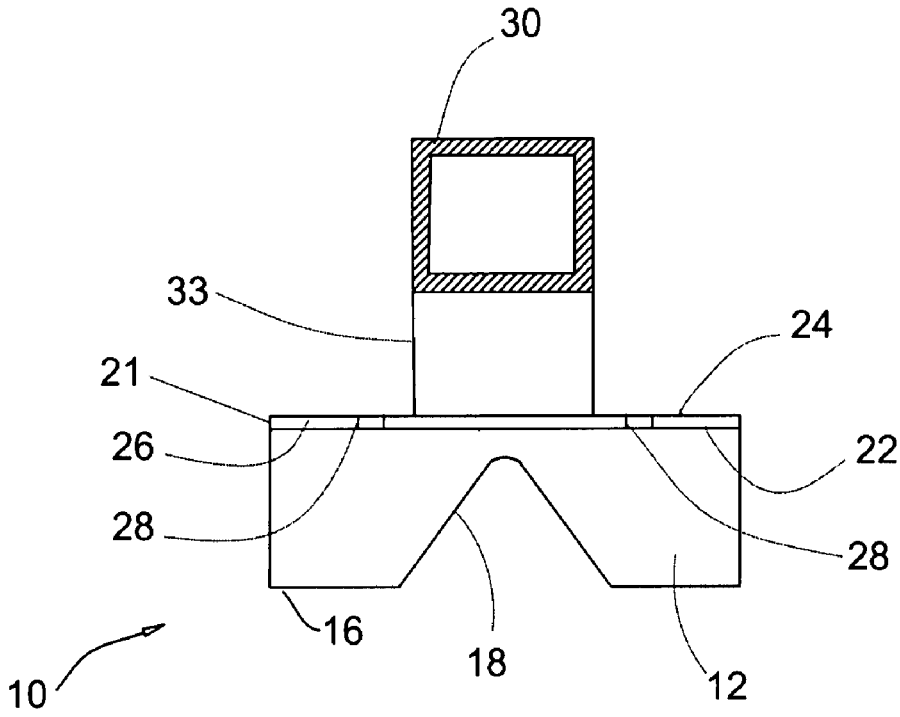
FIG. 2 is a top view, illustrating an embodiment of the clutching fixture component of the present invention, without loose chain. This top view of a clutching fixture 10 additionally depicts a clutch jaw 18, the posterior slot surface 24, the longitudinal support member 30, and a lower longitudinal support pedestal 33, which connects the clutch fixture 10 to the longitudinal support member 30.

The preferred embodiment of a post puller according to the present invention is generally a plurality of jawed and slotted clutch fixtures 10, FIG. 1 and FIG. 2, each fixture 10 having a clutch jaw 18 flanked by a pair of slots 28, each clutch jaw 18 having a pair of opposed clutch jaw edges 19, wherein each pair of opposed clutch jaw edges 19 is selected from a group of jaw edges consisting of a linear jaw edge and a concave curvilinear jaw edge, the latter typically formed as a shallow concave edge. Each fixture 10 is operatively fixed to one each of a plurality of support pedestals, including an upper longitudinal support pedestal 32 and a lower longitudinal support pedestal 33, the supporting pedestals operatively attached to a central support member 30, each fixture 10 employing loose chain 8, FIG. 5, FIG. 6, FIG. 7, (not claimed in the present invention) operatively and temporarily secured in appropriate slots 28 to encircle and subsequently clutch the post 40 to be extracted from the earth, the central support member 30 operatively associated with a positioning handle 34, FIG. 3, FIG. 4, FIG. 5, FIG. 6, FIG. 7, and a carriage mounted lifting force device 4 (not claimed in the present invention, such lifting device being able to supply sufficient force to overcome any resistance to forcibly removing the post from the ground, the lifting means attached to a portability carriage 2 (not claimed in the present invention having a pair of carriage wheels 3, the carriage moveable to initially align the post 40 within the clutch jaw 18 of each clutching fixture 10 for maximum lifting efficacy.

A critical component of the present invention is illustrated in FIG. 1 and FIG. 2, a frontal perspective view and a top view, respectively, of a clutching fixture 10, one of two such components incorporated in the preferred embodiment. Each fixture 10, comprising horizontal plate 11 and a complimentary vertical plate 21, is fabricated from a tough, durable material, including iron, steel, titanium, and aluminum alloy. Fabrication of the fixture 10 produces two rectangular plates, fixedly conjoined along a longer edge of each plate and generally each perpendicular to the other; alternatively, fixture 10 can be fabricated from a single rectangular plate, formed into two rectangular plates perpendicular to each other. One plate is generally and operatively horizontal, featuring an anterior clutch surface 12, a posterior clutch surface 14, a forward clutch edge 16, and a clutch jaw 18. The clutch jaw 18 is generally of "V" shape, extending inward from the forward clutch edge 16. The other perpendicular plate is generally and operatively vertical, featuring an anterior slot surface 22, a posterior slot surface 24, an upper slot edge 26, and a pair of slots 28.

The clutch jaw 18, having a pair of opposed clutch jaw edges 19, is symmetrically positioned along forward clutch edge 16 and extends completely through horizontal plate 11 from anterior clutch surface 12 to posterior clutch surface 14 and is deep enough and wide enough to accommodate a portion of post 40, encircled in loose chain 8, a portion of loose chain 8 firmly interposed between post 40 and clutch jaw 18.

The complimentary vertical plate 21 features a pair of slots 28 flanking clutch jaw 18, each such slot deep enough and wide enough to accommodate a single link of loose chain 8 placed on edge.

FIG. 1 and FIG. 2 additionally depict the relative positions of the central support member 30, and a support pedestal 33 which fixedly connects a fixture 10 together on the longitudinal support member 30.

Figure 3:
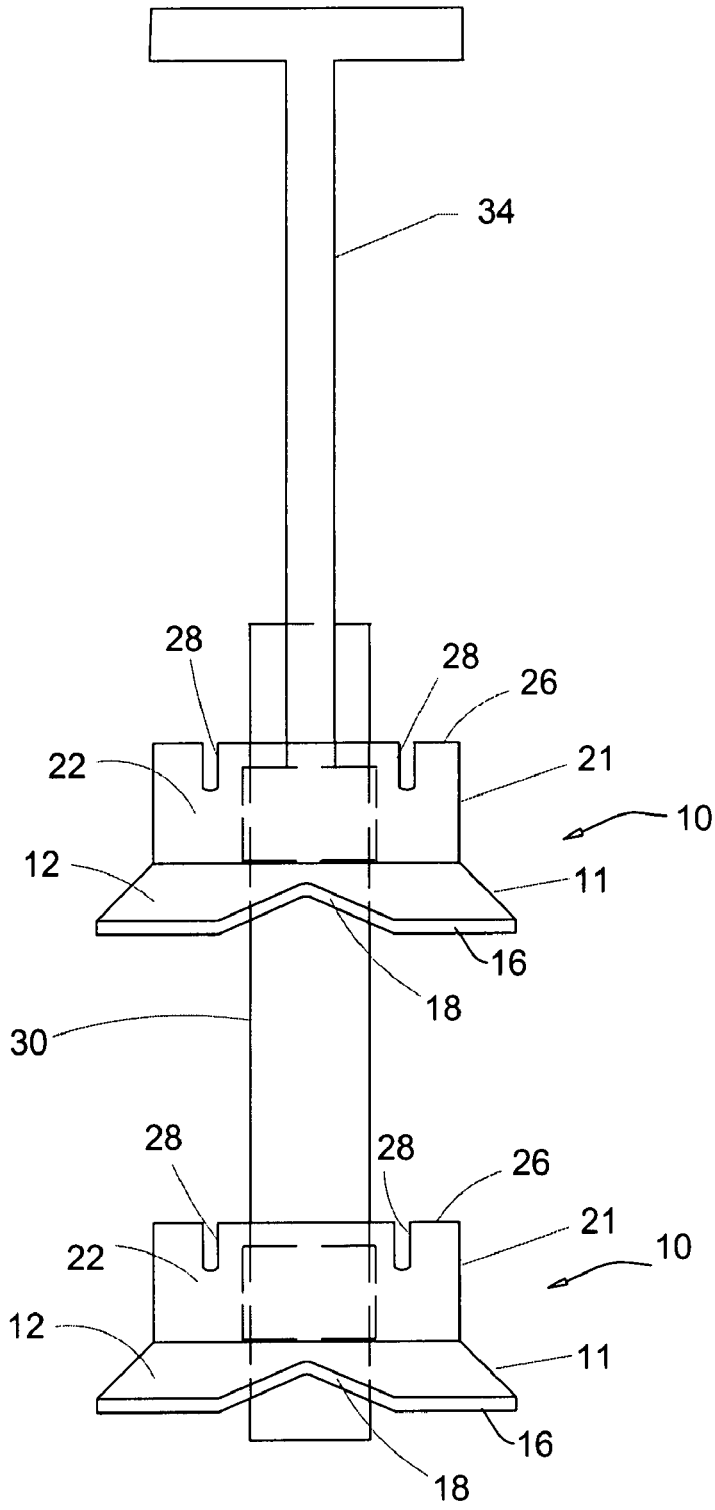
FIG. 3 is a frontal perspective view, illustrating a preferred embodiment of the present invention, without loose chain. The preferred embodiment employs two clutching fixtures 10, mounted one above the other on longitudinal support member 30. Also attached to support member 30 is the positioning handle 34.
Figure 4:
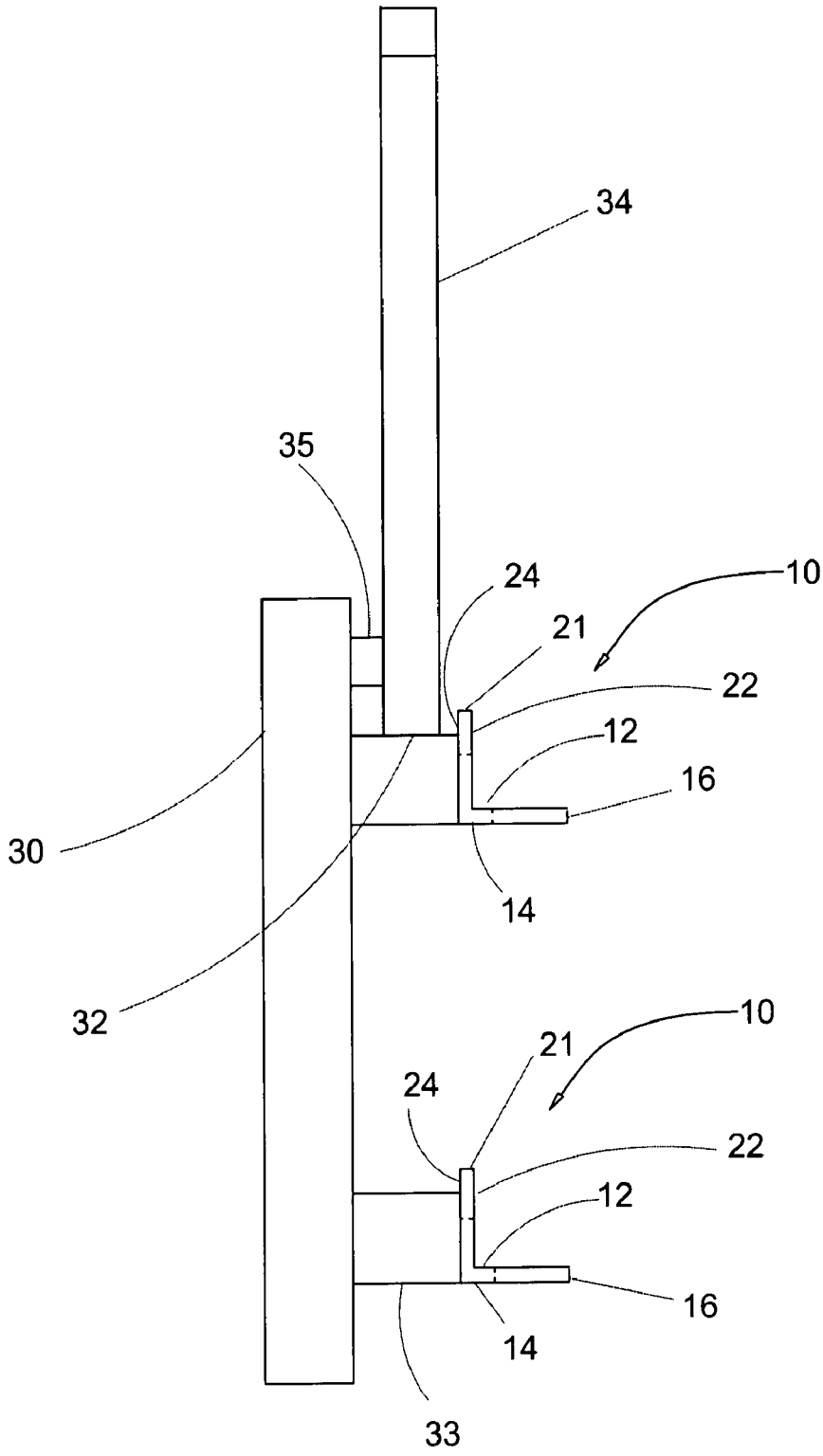
FIG. 4 is a side view, illustrating a preferred embodiment of the present invention, without loose chain. This view depicts how the lower clutching fixture is attached to support member 30 by means of lower longitudinal support pedestal 33; in like manner, the upper clutching fixture is attached to support member 30 by means of upper longitudinal support pedestal 32.

An embodiment of the present invention is depicted in FIG. 3, front perspective view, and FIG. 4, side view. This embodiment employs two clutching fixtures 10, each attached to the longitudinal support member 30 by means of support pedestals, 32, 33. The positioning handle 34 is securely attached to upper longitudinal support pedestal 32, and additionally to longitudinal support member 30, by means of handle pedestal 35. In this embodiment, the positioning handle 34 is used to maneuver the present in close proximity to the pole to be extracted from the ground; a lifting force device 4 (not claimed in the present invention), operatively attached to member 30, supplies sufficient force to remove the post 40.

Like FIG. 3 and FIG. 4, FIG. 5 illustrates an embodiment of the present invention. This frontal perspective view additionally depicts the loose chain 8 positioned in slots 28 of each of the two clutching fixtures 10. FIG. 6 shows this same embodiment in perspective, with a post 40 firmly clutched by chain 8.

FIG. 7 illustrates the preferred embodiment of the present invention incorporated with a suitable portability carriage 2 having carriage wheels 3 and lifting force device 4 (the carriage, the carriage wheels, and the lifting force device are not claimed in the present invention). This particular configuration is shown with the work piece post 40 encircled and securely clutched by chain 8 and drawn into the jaw clutch jaw 18 of each of the two clutching fixtures 10.

Upon application of an upward extraction force during the experimental development of the present invention, it was discovered that a pair of clutching fixtures 10, each with loose chain encircling a work piece post 40, that portion of encircling chain firmly interposed between post 40 and pair of opposed clutch jaw edges 19, and secured in the slots 28 produced an operatively tight hold on the post 40 when the pair of opposed clutch jaw edges 19 was linear and unexpectedly exhibited an even firmer grip on the post 40 when the pair of opposed clutch jaw edges 19 was somewhat curvilinear concave, each jaw edge enabling the lifting force device 4 to align the post 40 most efficiently in the jaw clutch and to extract a metal post from the ground without slippage.

Although only a few exemplary embodiments of the invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-functions clauses are intended to cover the structures described herein as performing the recited functions and not only structural equivalents but also equivalent structures.

What is claimed is:

1. A post puller for extracting a post embedded in the ground, said puller comprising, a longitudinal support member, said support member having means for operatively conjoining with a lifting force device providing an upward force sufficient to extract an embedded post, said support member having means for operatively conjoining with a carriage for ease and convenience of portability, said support member having an upper longitudinal support pedestal and a lower longitudinal support pedestal, each said pedestal permanently affixed to said support member, said support member further having a positioning handle, said handle operatively and permanently affixed to said upper longitudinal support pedestal and to a handle pedestal, said handle pedestal permanently affixed to said support member;

a plurality of clutching fixtures, one each said clutching fixture for each said support pedestal, each of said fixtures fabricated from a single rectangular piece of durable metal, the fabrication producing a horizontal rectangular plate and a vertical rectangular plate, each said plate perpendicular to the other, said horizontal plate having an anterior clutch surface, a posterior clutch surface, a forward clutch edge, and a clutch jaw of generally V shape, said clutch jaw having a pair of clutch jaw edges, said clutch jaw extending from said forward clutch edge, said clutch jaw extending through from the anterior clutch surface to the posterior clutch surface, said vertical plate having an anterior slot surface, a posterior slot surface, and a pair of slots flanking each said clutch jaw of each said horizontal plate, each of said slots having an upper slot edge and operatively formed to receive and securely hold a portion of loose chain, said posterior slot surface of each said clutching fixture fixedly attached to one of each said support pedestals, said clutch jaw of each of said clutching fixtures operatively longitudinally aligned with said longitudinal support member, said forward clutch edge facing away from said support member;

said post puller maneuverable with said positioning handle, positioning each of said plurality of clutch jaws proximate to a portion of the post to be extracted from the ground, providing for loose chain to be positioned at each said clutching fixture, a portion of the chain encircling the post tightly at each said clutching fixture, each end portion of the loose chain secured in one of each said pair of slots, each said pair of opposed clutch jaw edges of said clutch jaws in contact with a portion of the chain at each said clutching fixture, a portion of each chain interposed between a portion of the post and each said clutch jaw of each said clutching fixture, upon application of lifting and extraction force providing and maintaining a firm clutching force between the post and each of said clutching fixtures, for extracting a post embedded in the ground.

2. A post puller for extracting a post embedded in the ground as recited in claim 1, wherein the number of clutching fixtures is two.

3. A post puller for extracting a post embedded in the ground as recited in claim 2, wherein said pair of opposed clutch jaw edges is selected from a group consisting of straight and concave.

4. A post puller for extracting a post embedded in the ground as recited in claim 3, wherein said means for operatively conjoining with a carriage for ease and convenience of portability comprises a portability carriage similar to a hand truck, having a pair of carriage wheels, a base upon which to rest the carriage, and operatively affixed thereto means for providing a lifting force device sufficient to extract an embedded post.

5. A post puller for extracting a post embedded in the ground as recited in claim 4, wherein said affixed means for providing a lifting force device is selected from a group consisting of hydraulic jack, screw jack, rack and pinion, fulcrum and lever, and cable and windlass.

6. A post puller for extracting a post embedded in the ground as recited in claim 5, wherein said horizontal rectangle plate and said vertical rectangular plate of each said clutching fixture is formed from a single piece of durable material.

7. A post puller for extracting a post embedded in the ground as recited in claim 6, wherein said single piece of durable material is selected from a group consisting of iron, steel, titanium, and aluminum alloy.

8. A post puller for extracting a post embedded in the ground, said puller comprising, a longitudinal support member, said support member having means for operatively conjoining with a lifting force device sufficient to extract an embedded post, said support member having means for operatively conjoining with a carriage for ease and convenience of portability, said support member having a plurality of support pedestals, said plurality of support pedestals including an upper longitudinal support pedestal and a lower longitudinal support pedestal, each said pedestal permanently longitudinally affixed to said support member, said support member further having a positioning handle, said handle operatively and permanently affixed to said upper longitudinal support pedestal and to a handle pedestal, said handle pedestal permanently affixed to said support member;

a plurality of clutching fixtures, one each for each said plurality of support pedestals, each of said fixtures fabricated from a single rectangular piece of durable material to form a horizontal rectangular plate and a vertical rectangular plate, each said plate perpendicular to the other, said horizontal plate having an anterior clutch surface, a posterior clutch surface, a forward clutch edge, and a clutch jaw extending through from the anterior clutch surface to the posterior clutch surface, said clutch jaw having a pair of opposed clutch jaw edges in the general shape of an open V, the open V beginning at said forward clutch edge, said vertical plate having an anterior slot surface, a posterior slot surface, a forward slot edge, and a pair of slots, the posterior slot surface of each said clutching fixture fixedly attached to one of each said support pedestals, said clutch jaw of each of said clutching fixtures longitudinally aligned with said longitudinal support member, said forward clutch edge facing away from said support number;

said post puller maneuverable with said positioning handle, positioning each of said plurality of clutch jaws proximate to a portion of the post to be extracted from the ground, providing for loose chain to be positioned at each said clutching fixture, a portion of the chain encircling the post tightly at each said clutching fixture, each end portion of the loose chain secured in one of each said pair of slots, each said pair of opposed clutch jaw edges of said clutch jaws in contact with a portion of the chain at each said clutching fixture, a portion of each chain interposed between a portion of the post and each said clutch jaw of each said clutching fixture, upon application of lifting and extraction force providing and maintaining a firm clutching force between the post and each of said clutching fixtures, for extracting a post embedded in the ground.

9. A post puller for extracting a post embedded in the ground as recited in claim 8, wherein the number of support pedestals and clutching fixtures is two each.

10. A post puller for extracting a post embedded in the ground as recited in claim 9, wherein said pair of opposed clutch jaw edges is selected from a group consisting of straight and concave.

11. A post puller for extracting a post embedded in the ground as recited in claim 10, wherein said means for operatively conjoining with a carriage for ease and convenience of portability comprises a portability carriage similar to a hand truck, having a pair of wheels, a base upon which to rest the carriage, and operatively affixed thereto means for providing a lifting force device sufficient to extract an embedded post.

12. A post puller for extracting a post embedded in the ground as recited in claim 11, wherein said affixed means for providing a lifting force device is selected from a group consisting of hydraulic jack, screw jack, rack and pinion, fulcrum and lever, and cable and windlass.

13. A post puller for extracting a post embedded in the ground as recited in claim 12, wherein said horizontal rectangle plate and said vertical rectangular plate of each said clutching fixture is formed from a single piece of durable material.

14. A post puller for extracting a post embedded in the ground as recited in claim 13, wherein said single piece of durable material is selected from a group consisting of iron, steel, titanium, and aluminum alloy.

15. A post puller for extracting a post embedded in the ground, said puller comprising, a longitudinal support member, said support member having means for operatively conjoining with a lifting force device sufficient to extract an embedded post, said support member having means for operatively conjoining with a carriage for ease and convenience of portability, said support member having a plurality of support pedestals, said plurality of support pedestals including an upper longitudinal support pedestal and a lower longitudinal support pedestal, each said pedestal permanently affixed to said support member, said support member further having a positioning handle, said handle operatively and permanently affixed to said upper longitudinal support pedestal and to a handle pedestal, said handle pedestal permanently affixed to said support member;

a plurality of clutching fixtures, one each said clutching fixture for each said support pedestal, each of said fixtures having a horizontal rectangular plate and a vertical rectangular plate, fixedly conjoint along a longer edge of each, each said plate perpendicular to the other, said horizontal plate having an anterior clutch surface, a posterior clutch surface, a forward clutch edge, and a clutch jaw of generally V shape, said clutch jaw having a pair of pair of opposed clutch jaw edgess, said clutch jaw extending from said forward clutch edge, said clutch jaw extending through from the anterior clutch surface to the posterior clutch surface, said vertical plate having an anterior slot surface, a posterior slot surface, and a pair of slots flanking each said clutch jaw of each said horizontal plate, each of said slots having an upper slot edge and operatively formed to receive and securely hold a portion of loose chain, said posterior slot surface of each said clutching fixture fixedly attached to one of each said support pedestals, said clutch jaw of each of said clutching fixtures operatively longitudinally aligned with said longitudinal support member, said forward clutch edge facing away from said support member;

said post puller maneuverable with said positioning handle, positioning each of said plurality of clutch jaws proximate to a portion of the post to be extracted from the ground, providing for loose chain to be positioned at each said clutching fixture, a portion of the chain encircling the post tightly at each said clutching fixture, each end portion of the loose chain secured in one of each said pair of slots, each said pair of opposed clutch jaw edges of said clutch jaws in contact with a portion of the chain at each said clutching fixture, a portion of each chain interposed between a portion of the post and each said clutch jaw of each said clutching fixture, upon application of lifting and extraction force providing and maintaining a firm clutching force between the post and each of said clutching fixtures, for extracting a post embedded in the ground.

16. A post puller for extracting a post embedded in the ground as recited in claim 15, wherein the number of support pedestals and clutching fixtures is two each.

* * * * *